US005478200A

United States Patent [19]

Brodersen et al.

[11] Patent Number: 5,478,200

[45] Date of Patent: Dec. 26, 1995

[54] CENTRIFUGAL PUMP IMPELLER

[75] Inventors: Sönke Brodersen, Schriesheim; Peter Hergt, Ludwigshafen; Wolfgang Metzinger, Pegnitz; Paul Krieger, Mutterstadt, all of Germany

[73] Assignee: KSB Aktiengesellschaft, Frankenthal, Germany

[21] Appl. No.: 224,640

[22] Filed: Apr. 6, 1994

[30] Foreign Application Priority Data

Apr. 8, 1993 [DE] Germany ..... 43 11 746.5

[51] Int. Cl.[6] ..... F04D 29/42; F04D 29/22

[52] U.S. Cl. ..... 415/206; 416/186 R; 416/228; 416/234

[58] Field of Search ..... 416/179,228, 182, 416/185, 186 R, 223 B, 234; 415/206

[56] References Cited

U.S. PATENT DOCUMENTS

| | | | |
|---|---|---|---|
| 1,246,253 | 11/1917 | Fraser | 416/186 R |
| 1,946,273 | 2/1934 | Carr . | |
| 1,947,658 | 2/1934 | Pizzuto | 416/182 |
| 2,625,884 | 1/1953 | Welsh . | |
| 3,260,443 | 7/1966 | Garnett et al. | 416/186 R |
| 3,272,429 | 9/1966 | Wood | 416/186 R |
| 5,192,193 | 3/1993 | Cooper et al. . | |

FOREIGN PATENT DOCUMENTS

| | | | |
|---|---|---|---|
| 3704360A1 | 2/1987 | Germany . | |
| 253279A1 | 1/1988 | Germany . | |
| 0071640 | 2/1953 | Netherlands | 416/186 R |
| 294450 | 12/1952 | Switzerland . | |

OTHER PUBLICATIONS

DE AN SCH 2972 la/59b–Dec. 7, 1951; "A Comparison of Whole–Metal Pumps with Pumps Having Exchangeable Elastomeric Shells as Centrifugal Pumps For Limestone Suspensions in Flue Gas Desulfurizing Installations", Published in the Sammelband VGB–Konferenz, Kraftwerkkomponenten, 1986, by N. L. Lenhard.

*Primary Examiner*—Edward D. Look
*Assistant Examiner*—Christopher Verdier
*Attorney, Agent, or Firm*—Darby & Darby

[57] ABSTRACT

A centrifugal pump impeller for delivering solids-containing media includes a blade having a beginning portion. In the plane of the middle blade surface, there is, in front of the blade beginnings, a very flat transition from the impeller covering disks to the blade beginnings.

15 Claims, 3 Drawing Sheets

CENTRIFUGAL PUMP IMPELLER

BACKGROUND OF THE INVENTION

1. Field of the Invention

The present invention relates to a centrifugal pump impeller. More specifically, the present invention relates to a centrifugal pump impeller for delivering liquids that contain solids.

2. Discussion of the Related Art

BACKGROUND IN THE INVENTION

In centrifugal pumps for delivering liquids, which are mixed with solid components, such as sand or similar impurities, hydroabrasive wear occurs. This wear affects not only the service life, but also the operational dependability of the pump to a decisive degree. During the use of such pumps, it was observed that a very strong local wear of material at the impellers not only limits the service life of the whole pump, but can even lead to a sudden failure of the aggregate as a whole. The wear depends on the construction of the pump, its special geometric features and the areas in which the pump is used. The use of particularly thick walls for reducing wear phenomena, in order to increase the service life with the help of permissible material wear, is known. Other measures provide reinforcement for the blade beginnings, in order to thereby increase the resistance of the parts that wear.

In the paper by N. L. Lenhard entitled "A comparison of Whole-Metal Pumps With Pumps Having Exchangeable Elastomeric Shells as Centrifugal Pumps for Limestone Suspensions in Flue Gas Desulfurizing Installations", published in the Sammelband VGB-Konferenz, Kraftwerkkomponenten, 1986, such centrifugal pumps are described, for example. In FIG. 4 of this paper by N. L. Lenhard, a design for the inlet area of such an impeller is shown. This provides for a progression without defects in the meridional section. At the transition between the blades and the impeller covering disks, the impeller of cast construction, which is shown in meridional section, has known transition radii, which are required by the casting technology.

SUMMARY OF THE INVENTION

The present invention is based on the problem of developing, for centrifugal pump impellers, which are used to deliver liquids and for which hydroabrasive wear is to be expected, a measure to prolong the service life of the pump decisively.

The present invention includes a centrifugal pump impeller for delivering liquids that contain solids, including a pump housing. An impeller is disposed within the housing. The impeller comprises a suction side covering disk, a pressure side covering disk and at least one blade disposed between the covering disks. The at least one blade has a leading edge. The transition between the leading edge of the at least one blade and the covering disks includes a flat ascent transition from the covering disks to the leading edge. By means of this measure, the present invention achieves a service life for such an impeller that was increased by a multiple factor. Due to the flat transition or flat rise between the impeller covering disks and the beginning of the blade, occurring in the plane of the middle blade area, the prerequisite is created, according to which a turbulence field, occurring in this area and causing the wear, is minimized or prevented from developing. Accordingly, the possibility is eliminated that a turbulence field, with the solid particles contained therein, will produce material wear.

One embodiment of the present invention provides that the transitions of the blade beginnings from the impeller covering disks to the blades are in the form of arcs or straight lines with slopes of 0° to, at most, 30°. Because of the flat rise or flat transition from the impeller covering disks into the blade beginnings, provided for in the region of the middle area of the blade, a steady increase in flow velocity is brought about in the region of the leading edge of the blade. This prevents the development of backflow and, with that, the formation of a turbulence field, which can destroy the covering disks and the blade entry edges.

The flat transition in the plane of the middle blade area from the covering disks into the blade beginnings can be accomplished by applying and/or removing material. Basically, however, for the whole of the application, the concepts of applying and removing material are not used in a limiting and objective manner; instead, they describe the form in which the invention is different from what was known previously. In this sense, this applies also for the cast, injection molded or similarly produced impellers, for which a complete impeller is produced in one step. The impeller model or impeller shape, then used, already has the shape, which ensures the inventive contours. In the constructions below, the use of the concepts of applying and removing material thus refers to the general structural change in a previous blade or contour compared to the new. The flat transition in the region of the middle blade area to the blade beginnings is made possible by a measure, predominantly in the impeller covering disk region and comparable to a material removal. The same effect can be achieved by a measure, comparable to a material application in the corners between the impeller covering disk and the blade beginning. This measures should, however, always take place as an extension of the middle blade area over the blade beginnings. Compared to the previous or original course of the blade beginnings, the measures bring about a new course for the blade beginnings on the covering-disk side of the impeller. To a certain extent, the blade beginnings in the edge region on the covering-disk side of the impeller are clearly pulled forwards.

The same effect is also brought about by a measure corresponding to a removal of material at the covering disks in the region of the blade beginnings. This can take place in front of the blades in the covering disks, as well as with a combined solution, that is, material accumulation and material removal, by a further removal of material on the covering-disk side in the region of the blade beginnings.

Further embodiments of the present invention specify the orders of magnitudes of the transitions or material removals. The initial blade thickness is understood to be that blade thickness, which can be measured at the blade beginning after the rounding off radius between the blade suction side and the blade pressure side. Practical experiments have shown that, by inserting these values, the development of turbulences, which damage the covering disks and blade beginnings, can be prevented.

According to a different way of accomplishing the objective of the present invention, the blade beginnings with rounded off blade tips protrude from the impeller in the region of the impeller entrance diameter and the impeller covering disk on the suction side. The blade tip, which usually protrudes in the region of the impeller covering disk on the suction side, has a rounded-off tip here. With that, the flow in front of the entrance into the impeller is affected and the formation of a wear-producing turbulence field within the impeller and in front of the blade beginnings can thus be effectively prevented.

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein.

DETAILED DESCRIPTION OF THE PREFERRED EMBODIMENT

Figure 1:
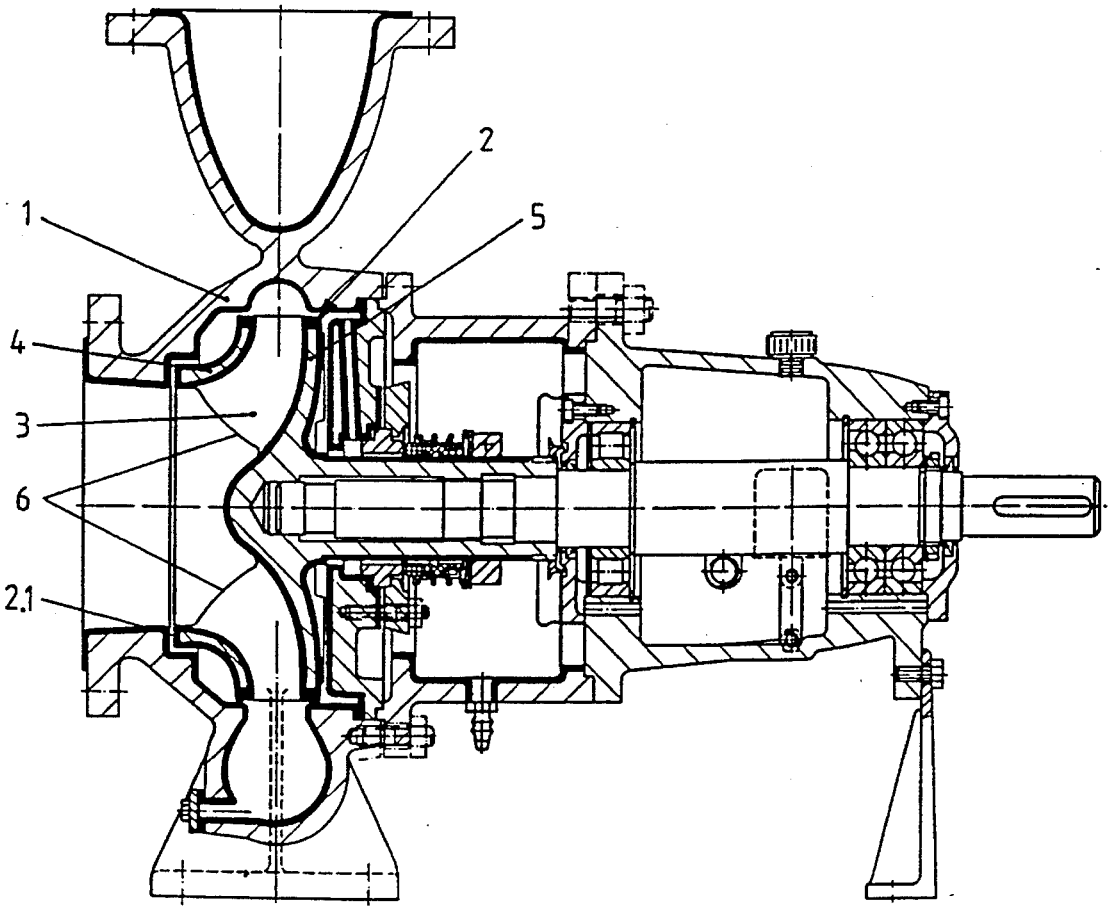
FIG. 1 shows a section through a centrifugal pump housing.

Referring now to FIG. 1, a centrifugal pump for delivering solids-containing media having one stage is illustrated. An impeller 2 is shown mounted inside of a housing 1. The blades 3 of the impeller 2, which are shown in meridional section and projected into the sectional plane, are disposed between the impeller covering disk 4 on the suction side and the impeller covering or supporting disk 5 on the pressure side. The beginning portion of the blade or leading edge 6 extends between the two covering disks 4, 5. As illustrated, the cross sectional area of the entrance of the impeller is limited by the end surface 2.1 of the impeller.

Figure 2:
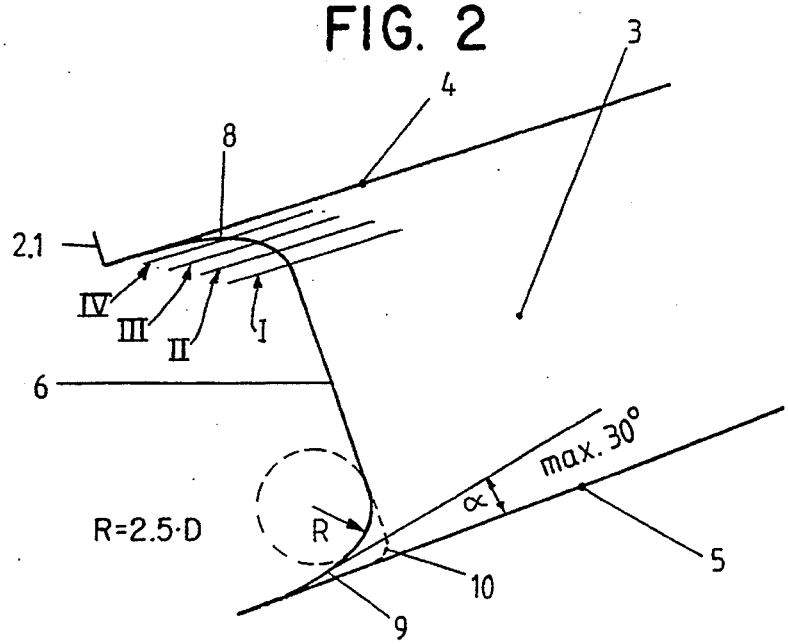
FIG. 2 shows the arrangement of a blade, cut in the region of its middle blade area and provided with material accumulations.

A plane arrangement of a blade, the section of which passes through the middle blade area, is illustrated in FIG. 2. In extension of this middle blade area beyond the blade beginnings 6, or in the case of the two-dimensional representation illustrated here, beyond the linear leading edge 6 of the blade, material accumulations 8, 9 of the blade 3 are placed at the beginning. As viewed in the flow direction, the transition from the impeller covering disks 4, 5 to the material accumulations 8.9, act as a pulled-ahead leading edge of the blade, and takes place at a very flat angle $\alpha$.

Figure 4:
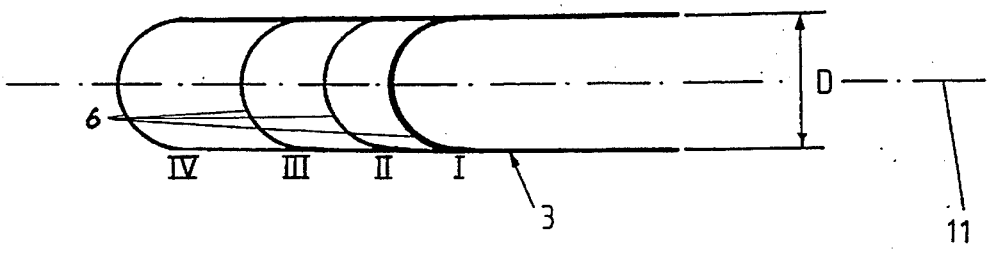
FIGS. 3 and 4 show sections through the arrangement of FIG. 2.
Figure 3:
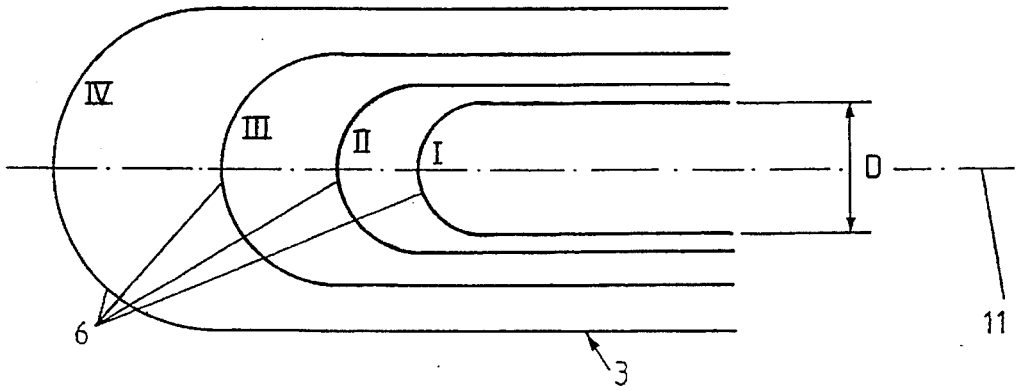

By using an arc-shaped transition from the impeller covering disk to the blade, for example, a circular arc, the radius of this arc R is preferably equal to or greater than 2.5 times the initial blade thickness D. The initial blade thickness D is predominantly constant here. However, in the initial region, which is shown in FIGS. 3 and 4 as a circular arc, it can increase over a short distance for other contours, such as ellipses. The transition radius R from the impeller covering disk to the blade beginning 6, shown in FIG. 2, is determined by the blade thickness measured at the blade beginning, that is, by the diameter of the semicircle at I. The above description of determining radius R holds when the blade surfaces are disposed perpendicularly to the covering disks. However, if the blade surfaces are inclined at an angle to the covering disks, then the radius R is determined by the blade thickness D resulting from a section running parallel to the impeller covering disk surface. As the inclination of the blades with respect to the impeller covering disks increases, the radius R also increases and thus develops a flat gradient.

On the other hand, if a straight line is used as another transition shape, the gradient of this line, at its starting point, must not exceed 30°. Larger angles would interfere with the afflux and cause the formation of material-abrading turbulences. The transition from the straight line into the blade beginning 6 then takes place in a flat form and the above-mentioned ratio of the radius to the initial blade thickness D also applies in this straight line transition shape.

The broken line 10, which is shown in FIG. 2 on only one side for reasons of clarity but does exist also in the region of the suction-side impeller covering disk 4, shows the usual and previously used course of the leading edge 6 of the blade. A small transition radii is shown between the blade 3 and the covering disks 4, 5, which resulted from the casting technology.

FIG. 3 shows a plan view of the blade 3 of FIG. 2, cut along the lines I—I to IV—IV. A blade is illustrated here, for which there is a small transition radius between the blade and covering disk in the region of the blade ducts. The lines, marked in this representation with the symbols I to IV, are comparable to contour lines. The line of dots and dashes 11 corresponds to the plane of the middle blade area. The blade thickness of the blade beginnings 6 is marked D.

FIG. 4 shows an embodiment, in which the blade 3 goes directly into the covering disk without any rounding-off radius. The blade beginning 6, pulled ahead in this region of the covering disk, has a constant, initial blade thickness D.

Figure 5:
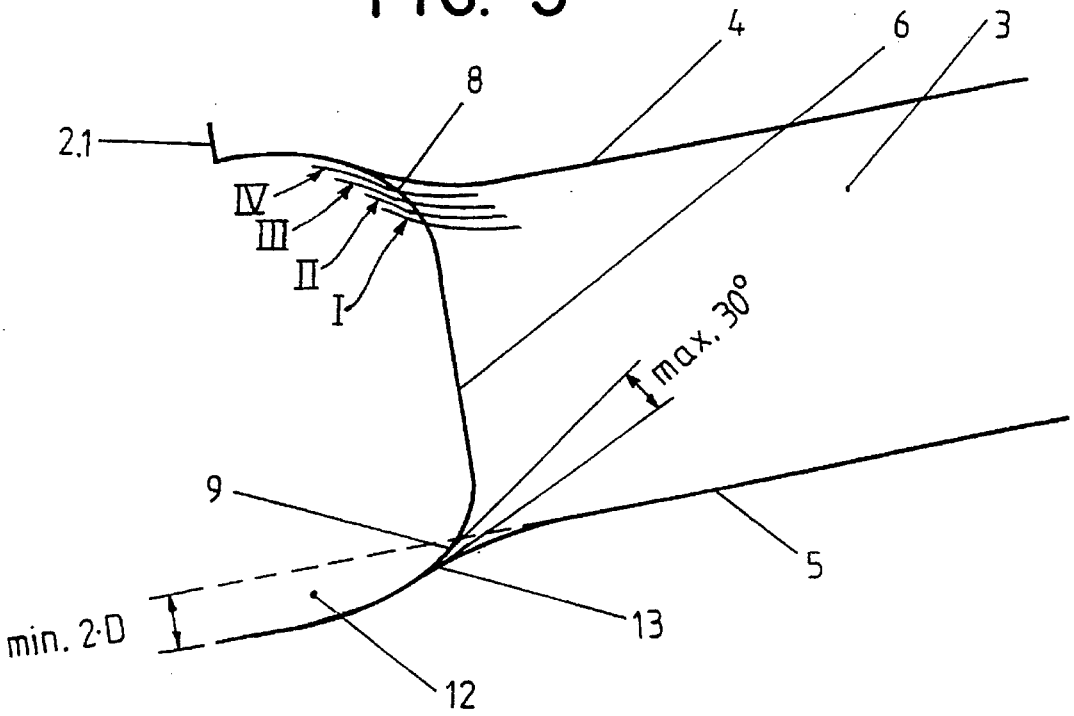
FIG. 5 shows an arrangement of a blade, cut in the region of its middle blade area, there being material removal in the transition between the covering disk and the blade.

FIG. 5 shows an embodiment, in which, due to removal 12 of material in the region of the covering disks 4, 5 as well as due to the application 8, 9 of material at the blade beginnings 6, there is a flat transition 13 in the plane of the middle blade area to the blade beginnings 6. The sectional lines I to IV, shown here, run parallel to the covering disk. Due to this course of the sectional line, there is a blade contour, similar to that shown in FIGS. 3 and 4 and corresponding to a height profile. The material 12 removed at the covering disks should correspond to at least twice the initial thickness D of the blades. In this representation, the material removal 12 extends into the blade duct. In a corresponding construction of the blade transitions to the covering disk, the enlargement can also end before the blade beginnings and leave the blade ducts unaffected.

Figure 6:
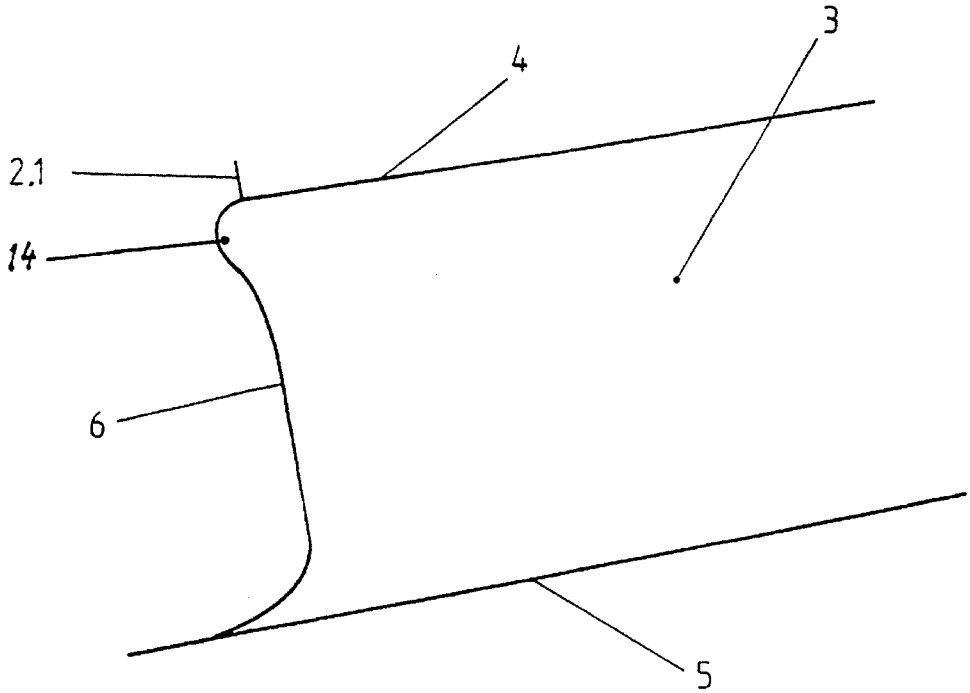
FIG. 6 shows an arrangement of a blade, which is cut in the region of its middle blade area and the blade tips of which protrude from the impeller.

FIG. 6 shows a blade tip 14, pulled forwards beyond the impeller end surface 2.1 in the region of the suction-side impeller covering disk 4. The flat slope into the blade beginnings 6, which has already been described above, is shown in the region of the impeller covering disk 5 on the pressure side. In one embodiment, the leading edge projects beyond an end surface of the impeller by less than twice an initial thickness of the blades.

From the forgoing description, it will be appreciated that the present invention makes available, a compact, cost efficient centrifugal pump impeller. Having described the presently preferred exemplary embodiment of a new and improved centrifugal pump impeller in accordance with the present invention, it is believed that other modifications, variations and changes will be suggested to those skilled in the art in view of the teachings set forth herein. It is, therefore, to be understood that all such variations, modifications, and changes are believed to fall within the scope of the present invention as defined by the appended claims.

What is claimed is:

1. A centrifugal pump for delivering liquids that contain solids comprising:

a pump housing;

an impeller being disposed within said housing, said impeller comprising a suction side covering disk, a pressure side covering disk and at least one blade disposed between said covering disks, said at least one blade having a leading edge;

the transition between the leading edge of said at least one blade and the covering disks includes a flat ascent transition from the covering disks to the leading edge.

2. The centrifugal pump of claim 1, wherein the flat ascent transition slopes between a range of 0° to a maximum of 30°.

3. The centrifugal pump of claim 2, wherein the flat ascent transition forms an arc-shape into the leading edge and the arc-shape has a radius, which is greater than or equal to 2.5 times an initial thickness of said at least one blade.

4. The centrifugal pump of claim 3, wherein a cross section between the covering disks is constricted in nozzle-shape in the flow direction starting from the leading edge.

5. The centrifugal pump of claim 4, wherein the depth of a material removal at the impeller covering disks is at least twice as great as the initial thickness of the blade.

6. A centrifugal pump for delivering liquids that contain solids comprising:

a pump housing;

an impeller being disposed within said housing, said impeller comprising a suction side covering disk, a pressure side covering disk and at least one blade disposed between said covering disks, said at least one blade having a leading edge;

in the region of an impeller entrance diameter and the suction side covering disk, the leading edge protrudes out of the impeller with a rounded off blade tip and the transitions between the leading edge of said at least one blade and the pressure side covering disk include a flat ascent transition from the pressure side covering disk to the leading edge.

7. The centrifugal pump of claim 6, wherein the leading edge projects beyond an end surface of the impeller by less than twice an initial thickness of the blades.

8. The centrifugal pump of claim 2, wherein the flat ascent transition forms a straight line into the leading edge.

9. The centrifugal pump of claim 1, wherein the fiat ascent transition is disposed in the plane of the middle blade area.

10. The centrifugal pump of claim 2, wherein the flat ascent transition is formed by material accumulation of said at least one blade.

11. The centrifugal pump of claim 2, wherein the flat ascent transition is formed by material removals of said covering disks.

12. The centrifugal pump of claim 10, wherein the flat ascent transition is also formed by material removal of said covering disks.

13. The centrifugal pump of claim 6, wherein the fiat ascent transition slopes between a range of 0° to a maximum of 30°.

14. The centrifugal pump of claim 13, wherein the flat ascent transition forms an arc-shape into the leading edge and the arc-shape has a radius, which is greater than or equal to 2.5 times an initial thickness of said at least one blade.

15. The centrifugal pump of claim 14, wherein a cross section between the covering disks is constricted in nozzle-shape in the flow direction starting from the leading edge.

* * * * *